US008720072B2

(12) United States Patent
Bucco

(10) Patent No.: US 8,720,072 B2
(45) Date of Patent: May 13, 2014

(54) RAZOR WITH THREE-AXIS MULTI-POSITION CAPABILITY

(76) Inventor: Thomas J. Bucco, Setauket, NY (US)

( * ) Notice: Subject to any disclaimer, the term of this patent is extended or adjusted under 35 U.S.C. 154(b) by 390 days.

(21) Appl. No.: 13/030,752

(22) Filed: Feb. 18, 2011

(65) Prior Publication Data

US 2011/0138637 A1 Jun. 16, 2011

Related U.S. Application Data

(60) Provisional application No. 61/372,662, filed on Aug. 11, 2010.

(51) Int. Cl.
*B26B 21/00* (2006.01)
*B26B 21/52* (2006.01)

(52) U.S. Cl.
USPC ..... 30/527; 30/32; 30/529

(58) Field of Classification Search
USPC ..... 30/32, 527, 529
IPC ..... B26B 021/00,021/52
See application file for complete search history.

(56) References Cited

U.S. PATENT DOCUMENTS

| | | | | | |
|---|---|---|---|---|---|
| 1,450,604 | A * | 4/1923 | Mossberg | 30/529 |
| 2,510,951 | A * | 6/1950 | Bleeker et al. | 30/40 |
| 4,083,103 | A * | 4/1978 | Estandian | 30/47 |
| 4,163,316 | A * | 8/1979 | Hagmann et al. | 30/47 |
| 4,926,553 | A * | 5/1990 | Miskin et al. | 30/49 |
| 5,007,168 | A * | 4/1991 | Messinger et al. | 30/43 |
| 5,167,069 | A * | 12/1992 | Quinn | 30/527 |
| 5,560,106 | A * | 10/1996 | Armbruster et al. | 30/527 |
| 5,606,799 | A * | 3/1997 | Melton | 30/216 |
| 5,704,127 | A * | 1/1998 | Cordio | 30/49 |
| 5,953,824 | A * | 9/1999 | Ferraro et al. | 30/527 |
| 7,140,116 | B2 * | 11/2006 | Coffin | 30/531 |
| 2004/0181953 | A1 * | 9/2004 | Follo et al. | 30/527 |
| 2009/0255124 | A1 * | 10/2009 | Hasbani | 30/50 |

FOREIGN PATENT DOCUMENTS

| | | |
|---|---|---|
| DE | 2006011254 | 12/2006 |
| FR | 2639280 | 5/1990 |
| GB | 2458316 | 9/2009 |
| GB | 2463035 | 3/2010 |

OTHER PUBLICATIONS

International Search Report and Written Opinion dated Jan. 6, 2012 in corresponding International Application No. PCT/US2011/047330.
Supplementary European Search Report, dated Nov. 22, 2013.

* cited by examiner

*Primary Examiner* — Ghassem Alie
*Assistant Examiner* — Bharat C Patel
(74) *Attorney, Agent, or Firm* — Ostrolenk Faber LLP

(57) ABSTRACT

A razor includes a handle and detachable blade cartridge. The end of the handle has a pivot sphere upon which the blade cartridge is rotatably mounted, with freedom to pivot around three axes of the handle, and otherwise holds its orientation relative to the handle. The blade cartridge is held to the pivot sphere by a clevis having recesses defined in at least the inner side surfaces of its legs. The recesses, together with the clevis, are sized to admit the pivot sphere between them and to hold the sphere therein once admitted. The clevis and/or the pivot sphere can be formed of a resilient injection molded plastic. The range of motion of the blade cartridge can be limited by forming one or more stops on the pivot sphere to interact with the clevis and thereby interrupt its free rotation.

16 Claims, 1 Drawing Sheet

RAZOR WITH THREE-AXIS MULTI-POSITION CAPABILITY

CROSS REFERENCE TO RELATED APPLICATIONS

The present application claims priority to U.S. Provisional Application Ser. No. 61/372,662, filed Aug. 11, 2010.

BACKGROUND

1. Field

The present invention relates to the field of consumer products and particularly to a razor with blade holder that is pivotable around three axes.

2. Description of Related Art

In a shaving tool for personal grooming, one well-known design is the safety razor that has a blade cartridge holding one or more blades at an appropriate angle for shaving, with the blade cartridge connected to a handle. As the face, etc. or other body portion being shaven is not flat, the user must articulate the handle around three axes while moving the blade over the skin to achieve a suitable result. This requires a certain level of dexterity on the part of the user.

In recognition of this, it is known to mount the blade cartridge to the handle in a manner to allow the blade cartridge to pivot around an axis parallel to the cutting edge(s) of the blades. However, this limited range of motion still requires the manual dexterity of the user to rotate the blade around other axes. Therefore, a better solution is lacking.

SUMMARY

A razor according to the instant disclosure includes a handle and detachable blade cartridge. The end of the handle has a pivot sphere upon which the blade cartridge is rotatably mounted, with freedom to pivot around three axes of the handle, and otherwise holds its orientation relative to the handle. The blade cartridge is held to the pivot sphere by a clevis having recesses defined in at least the inner side surfaces of its legs. The recesses, together with the clevis, are sized to admit the pivot sphere between them and to hold the sphere therein once admitted. The clevis and/or the pivot sphere can be formed of a resilient injection molded plastic. The range of motion of the blade cartridge may be limited by forming one or more stops on the pivot sphere to interact with the clevis and thereby interrupt its free rotation.

In a particular embodiment, a personal grooming apparatus comprises a handle having a gripping portion and an attachment portion operative to rotably support a cartridge for rotational movement around at least two axes. The cartridge includes a clevis with first and second opposed legs, spaced from one another, each of the first and second legs having a respective recess in a side facing the opposing leg, the respective recesses sized, shaped and positioned such that the attachment portion is received simultaneously in both recesses, with the cartridge being pivotably mounted upon the attachment portion with freedom of motion around at least two axes.

In a further embodiment, the cartridge comprises a central recess between the first and second legs receiving and substantially covering an end of the attachment portion. The attachment portion may comprise a sphere or part thereof having a first radius. The sphere or part thereof may comprise a plurality of elements approximating the surface of the sphere. At least one of the plurality of elements approximating the surface of the sphere may be resilient to facilitate attachment between the sphere or part thereof with the cartridge.

In a further embodiment, the central recess may comprise either a spherical section or a toroidal section, the spherical section or toroidal section being defined by a radius substantially equal to, or greater than, the first radius of the sphere or part thereof.

The recesses in each of the first and second legs may be either cylindrical or spherical recesses. At least one of the recesses in each of the first and second legs may be a through opening that perforates the side of its respective first or second leg facing away from the opposing leg.

In a further embodiment, at least one of the first and second legs comprises a relief portion inclined toward the opposing one of said first and second legs, said relief portion being operative to facilitate the insertion of the attachment portion between the first and second legs. The relief portion may comprise a spherical section surface, optionally having a radius substantially equal to or greater than that of the sphere of the attachment potion, where the attachment portion is provided with a sphere or part thereof.

In a particular embodiment, at least one of the first and second legs comprise a resilient material, said leg being operative to deflect under the pressure of the attachment portion upon insertion of the attachment portion between the first and second legs, and thereby admit the attachment portion between the first and second legs.

In a further embodiment, the attachment portion further comprises at least one stop extending above its surface to partially obstruct the rotation of the cartridge when the cartridge is mounted upon the attachment portion. In a further embodiment, two symmetric and diametrically opposed stops are provided.

The cartridge may be mounted on the attachment portion operative to hold the orientation of the cartridge with respect to the handle at rest, yet pivot freely under an applied pressure.

The attachment portion may comprise an attachment arm by which it is mounted to the handle. The attachment arm may extend at an angle to the axis of the handle. The attachment arm may further be configured to reduce in diameter, for example as a frusto-conical shape, and may further be attached to the handle by the relatively larger-diameter portion of the attachment arm.

These and other features, advantages and benefits of the present disclosure will become apparent from the following description.

DETAILED DESCRIPTION OF THE FIGURES

DETAILED DESCRIPTION OF THE EMBODIMENTS

Figure 1:
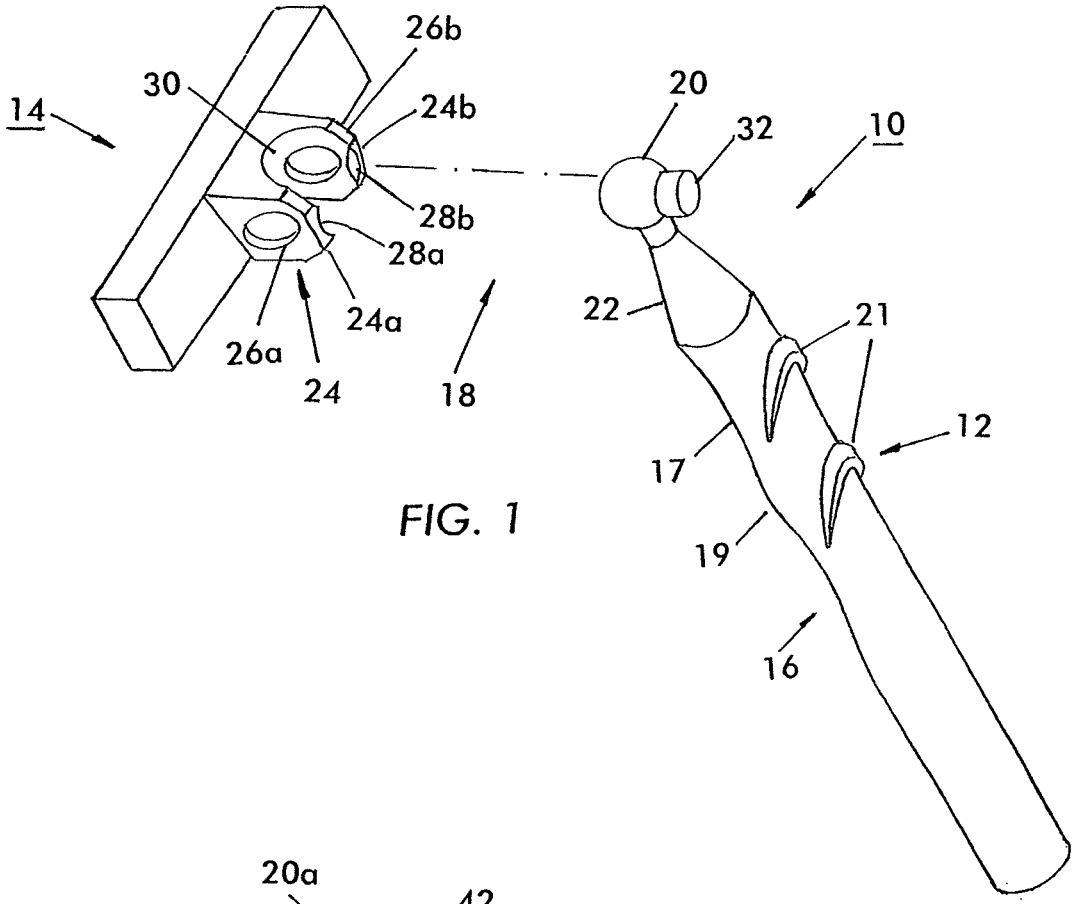
FIG. 1 illustrates a razor according to an exemplary embodiment of the present disclosure, in an exploded assembly view wherein a blade cartridge thereof is separated from the handle along the phantom line.

Referring now to FIG. 1, illustrated is an exploded assembly view of a three axis safety razor, generally 10, according to an exemplary embodiment of the present disclosure. The razor 10 includes a handle 12, and a blade cartridge 14 pivotally connected to the handle 12. The handle 12 includes a gripping portion 16. The gripping portion 16 is illustrated as generally cylindrical, however, it is contemplated, and, in fact, preferred that the gripping portion 16 have some features to enhance its friction when held in the hand of the user.

Among these features, without limitation, the shape of the gripping portion 16 may be varied from the generally right circular cylinder as illustrated, for example, to other prismatic shapes such as triangular, rectangular (including square) or hexagonal prisms, among others, and/or to optionally include some combination of lands and curves. The gripping portion 16 may be further provided with one or more localized depressions 17 and/or protuberances 19 to receive the fingers of a user's hand. The surface of the gripping portion 16 may be provided with texture and/or friction enhancements, including without limitation knurling, localized or general surface roughening, and friction-enhancing appliqués 21, including those which may raise the height of the surface to which they are applied.

At a first end 18 of the handle 12, a pivot sphere 20 is secured to and/or made part of the handle 12. Designating the structure as a pivot sphere does not preclude the possibility that the pivot sphere may be only partially spherical, as described further below. In a further embodiment, shown for example in FIG. 2, the pivot sphere may be formed by a plurality of elements 40 approximating a sphere (or part thereof). Optionally, those elements 40 may themselves be resilient to deform from a spherical surface to permit the pivot sphere 20 to be connected with the blade cartridge 14. Moreover, in the embodiment illustrated in FIG. 2, the gaps 42 between elements 40 are substantially parallel with one another and circumferential with the sphere 20. This need not be the case, however. As well, the gaps may be formed around poles of the sphere that are not substantially aligned with the stops 32*a*, 32*b*, as illustrated. For example, the gaps 42 may be formed to meet at or near the attachment with arm 22. Other variations will be apparent to those of skill in the art, in light of the instant disclosure.

Returning to the exemplary embodiment, pivot sphere 20 is mounted to the handle 12 at the end of an arm 22. Arm 22 preferably achieves a reduction in diameter from the gripping portion 16 of the handle 12, to reduce and/or avoid obstructing the pivoting of the blade cartridge 14 about the pivot sphere 20. In the exemplary embodiment, arm 22 is frustoconical in shape, with a smaller diameter end adjacent to and connected with the pivot sphere. Moreover, the arm 22 may be offset such that its longitudinal axis diverges from a longitudinal axis of the handle 12 generally, or gripping portion 16 specifically, in order to further distance the blade cartridge 14 from the handle 12. In alternate embodiments, the arm 22 supporting the pivot sphere 20 may be mounted along the length of the handle 12, rather than at or near an end. One manner of mounting the arm 22 may be substantially perpendicular to the axis of the handle 12, approximating a "T"-shape between the handle 12 and the arm 22. Other configurations, e.g., "C", "J", "L", "Y"-shaped combinations of handle 12 and arm 22, are clearly conceivable within the scope of the instant disclosure.

Blade cartridge 14 includes a clevis 24 for pivotably securing the blade cartridge 14 to the pivot sphere 20. The clevis 24 includes two opposed legs 24*a*, 24*b*. Each leg 24*a*, 24*b* has a hole 26*a*, 26*b*, respectively. In the exemplary embodiment, holes 26*a*, 26*b* are through holes which traverse their respective legs 24*a*, 24*b*, however, they need not perforate the legs 24*a*, 24*b* entirely. Holes 26*a*, 26*b* are sized and spaced such that the clevis 24 can be installed over the pivot sphere 20, and be retained there in connection with the handle 12. The tolerances of fit between the clevis 24, specifically holes 26*a*, 26*b*, and pivot sphere 20, are readily adjustable by those having skill in the art without departing from the scope of the present disclosure. In a preferred embodiment, the tolerances are set to achieve a fit between clevis 24 and sphere 20 such that the cartridge 14 holds its orientation with respect to the handle 12 at rest, yet pivots freely under any applied pressure.

In the exemplary embodiment, the clevis 24 is optionally provided with a recess 30, between legs 24*a*, 24*b* and below holes 26*a*, 26*b*. The recess may be configured as a spherical section, or alternately may resemble a portion of a torus. The radius of the recess 30 when configured as a spherical section, or the outer radius of the torus section where configured as such, is preferably no smaller than the diameter of the pivot sphere 20. The recess should not interfere with the pivoting of the blade cartridge on the pivot sphere. A close fit between the pivot sphere 20 and the recess 30 may enhance the ability of the cartridge 14 to hold its position, and can also inhibit the ingress of water or shaving detritus (e.g., foam, cut hair, etc.) that might inhibit the ability of the cartridge to change position under pressure.

The nature of the fit between the clevis 24 and the pivot sphere 20 is that the maximum diameter of the pivot sphere 20 is greater than the distance between the legs 24*a*, 24*b*, and their included holes 26*a*, 26*b*, or more specifically, the nearest facing surfaces of legs 24*a*, 24*b* and/or holes 26*a*, 26*b*. To accommodate the assembly of the cartridge 14 with the handle 12, either the pivot sphere 20, or one or both of legs 24*a*, 24*b*, or any of them, may be constructed of a resilient material which yields to the degree necessary to mate the cartridge 14 to the handle 12, yet return to their previous respective states once assembled.

The clevis 24 may be provided with one or more relief portions 28*a*, 28*b* as illustrated. Relief portions in this exemplary embodiment are generally spherical sections, and preferably have a radius at least as great as that of the pivot sphere 20. Relief portions 28*a*, 28*b* guide and ease the interface between the pivot sphere 20 and the clevis 24 on their assembly. In connection with this, making the interface between the pivot sphere 20 and the clevis 24 easy and reliable makes it possible to allow the user to exchange and replace the blade cartridge 14 at that interface in the ordinary course of use. This eliminates the need for an additional point of separation to achieve a blade change, thereby simplifying the construction of the blade cartridge 14. However, this does not exclude an additional point of separation, pivoting and/or articulation in connection with blade cartridge 14 described in the present disclosure.

The clevis 24 described herein is advantageously formed of an injection molded plastic and/or metal, for economic benefits in cost of material and manufacture. Alternately, the clevis 24 can be formed and injection molded integrally with the frame of the blade cartridge 14, which is completed by the addition of the blades themselves, among other accessories as desired.

As described above, a razor 10 has a blade cartridge 14 that can freely move around three axes of the handle 12. However, while such freedom of motion is desirable, it may be further desired to limit the range of motion of the blade cartridge 14, for example to avoid extreme or unusual orientations of the blade cartridge 14. This can be accomplished by altering the shape of the pivot sphere 20, for example to provide a stop 32. The stop 32 is sized and positioned to obstruct the clevis 24, and thereby limit its range of motion about the pivot sphere 20. In the exemplary embodiment disclosed, the stop 32 is formed integrally with the remainder of the pivot sphere 20, as a molded part thereof. Alternately, the stop 32 may be a separate structure, secured either permanently or removably to the pivot sphere 20, for example, without limitation, by adhesive or fastener. One or more such stops 32 may be provided, which individually or in combination can permit nearly any desired range of motion in the blade cartridge 14 about the handle 12.

The stop 32 is illustrated in FIG. 1 as a simple circular cylindrical projection. However, the size, shape and height of the stop 32, or several of them, may be selected as desired in consideration of the shape of the clevis 24 and specifically its legs 24*a*, 24*b*. The stop 32 may be shaped to obstruct movement in certain orientations, but not in others. As an example only, once connected in the orientation illustrated in FIG. 1, the stop 32 largely inhibits the lateral rotation of the blade cartridge 14. On the other hand, the blade cartridge 14 is free to rotate about its transverse axis, to 'lift its head' in a manner of speaking. Having done so, the blade cartridge now has additional freedom of lateral rotation, not possible in the prior orientation because of the interaction of the legs 24*a*, 24*b* with the stop 32. This discussion is offered merely as an example of the possible range of motion that could be obtained by the configuration of the stop 32, and further alteration will be apparent to those of ordinary skill in the art in light of the instant disclosure.

Figure 2:
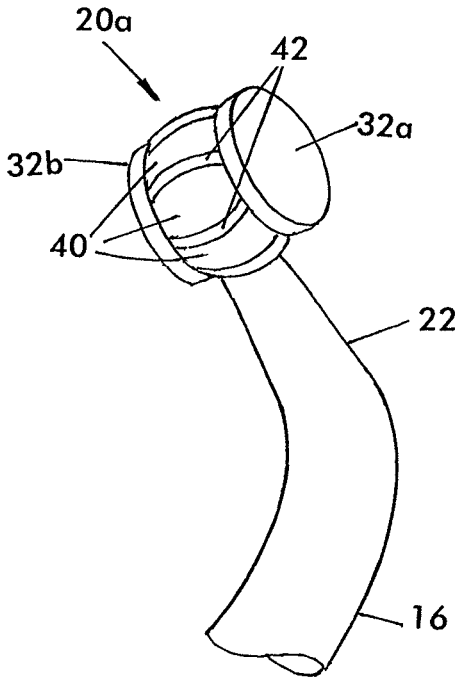
FIG. 2 illustrates an alternate embodiment of a razor according to the present disclosure, as a detail view of the end of handle.

In one embodiment, illustrated in FIG. 2, two such stops 32*a*, 32*b* are substantially diametrically opposed to one another on the pivot sphere 20. Stops 32*a*, 32*b* are, in this embodiment formed by deforming a spherical section into a plane, with the excess material rising above the surface of the sphere 20 to restrict the movement of the blade cartridge 14. The embodiment of FIG. 2 includes the planes formed by this method of creating stops 32*a*, 32*b* being angled with respect to one another. The planes are closer together at the attachment of the sphere 20 with the arm 22. They may, in other embodiments, be angled differently, or parallel with each other.

The foregoing disclosure has been made with reference to certain exemplary and/or preferred features and embodiments. These are not limiting upon the scope of the disclosure. Certain modification, alterations, or substitutions will be apparent to those of ordinary skill in the art in light of the present disclosure.

What is claimed is:

1. A personal grooming apparatus comprising:

a handle having a gripping portion and an attachment portion operative to rotably support a cartridge for rotational movement around at least two axes; and a cartridge having a clevis with first and second opposed legs, spaced from one another, each of the first and second legs having a respective recess in a side facing the opposing leg, the respective recesses sized, shaped and positioned such that the attachment portion is received simultaneously in both recesses, with the cartridge being pivotably mounted upon the attachment portion with freedom of motion around as least two axes, wherein the attachment portion includes a spherical surface and at least one stop extending from and above the surface thereof to at least partially obstruct rotation of the cartridge when the cartridge is mounted on the attachment portion.

2. The personal grooming apparatus according to claim 1, wherein the cartridge further comprises a central recess between the first and second legs receiving and substantially covering an end of the attachment portion.

3. The personal grooming apparatus according to claim 1, wherein the attachment portion comprises a sphere or part thereof having a first radius.

4. The personal grooming apparatus according to claim 3, wherein the sphere or part thereof comprises a plurality of elements approximating the surface of the sphere.

5. The personal grooming apparatus according to claim 4, wherein at least one of the plurality of elements approximating the surface of the sphere is resilient to facilitate attachment between the sphere or part thereof with the cartridge.

6. The personal grooming apparatus according to claim 3, wherein the cartridge further comprises a central recess between the first and second legs receiving and substantially covering an end of the attachment portion, the central recess comprising either a spherical section or a toroidal section, said spherical section or toroidal section being defined by a radius substantially equal to or greater than the first radius.

7. The personal grooming apparatus according to claim 1, wherein the recesses in each of the first and second legs are one of cylindrical or spherical recesses.

8. The personal grooming apparatus according to claim 1, wherein at least one of the recesses in each of the first and second legs is a through opening that perforates the side of its respective first or second leg facing away from the opposing leg.

9. The personal grooming apparatus according to claim 1, wherein at least one of the first and second legs comprises a relief portion inclined toward the opposing one of said first and second legs, said relief portion being operative to facilitate the insertion of the attachment portion between the first and second legs.

10. The personal grooming apparatus according to claim 9, wherein the relief portion comprises a spherical section surface.

11. The personal grooming apparatus according to claim 10, wherein the attachment portion comprises a sphere or part thereof being defined by a first radius, and the spherical section surface has a second radius substantially equal to or greater than that of the first radius.

12. The personal grooming apparatus according to claim 1, wherein at least one of the first and second legs comprise a resilient material, said leg being operative to deflect under the pressure of the attachment portion upon insertion of the attachment portion between the first and second legs, and thereby admit the attachment portion between the first and second legs.

13. The personal grooming apparatus according to claim 1, wherein the cartridge is mounted on the attachment portion operative to hold the orientation of the cartridge with respect to the handle at rest, yet pivots freely under an applied pressure.

14. The personal grooming apparatus according to claim 1, wherein the attachment portion comprises an attachment arm by which the attachment portion is mounted to the handle.

15. The personal grooming apparatus according to claim 14, wherein the attachment arm extends at an angle to the axis of the handle.

16. The personal grooming apparatus according to claim 14, wherein the attachment arm is frusto-conical in shape, and is attached to the handle by the relatively larger-diameter portion of the attachment arm.

* * * * *